United States Patent [19]

Bayless

[11] 4,008,413

[45] Feb. 15, 1977

[54] COMPACT HIGH VOLTAGE FEEDTHROUGH FOR GAS DISCHARGE DEVICES

[75] Inventor: John R. Bayless, Malibu, Calif.

[73] Assignee: Hughes Aircraft Company, Culver City, Calif.

[22] Filed: Mar. 3, 1975

[21] Appl. No.: 553,875

[52] U.S. Cl. ..... 313/331; 174/17.05; 174/50.55; 174/73 R; 313/220; 313/318

[51] Int. Cl.[2] ..... H01J 19/62

[58] Field of Search ..... 174/17.05, 17.08, 50.55, 174/73 R, 140 R; 313/220, 318, 331, 187, 313, 481, 482, 217, 219; 315/39

[56] References Cited

UNITED STATES PATENTS

| | | | |
|---|---|---|---|
| 1,957,983 | 5/1934 | Smith | 174/50.55 |
| 2,909,695 | 10/1959 | Melhart | 313/217 X |
| 3,405,275 | 10/1968 | Bergan | 174/140 R |
| 3,831,052 | 8/1974 | Knechtli | 313/187 |

*Primary Examiner*—J. V. Truhe
*Assistant Examiner*—D. A. Tone
*Attorney, Agent, or Firm*—Fay I. Konzem; W. H. MacAllister

[57] ABSTRACT

A support structure and electrode design geometry for a compact high voltage feedthrough, which is used in low-pressure gas discharge devices. The high voltage coaxial cable which applies voltages to the various electrodes within the discharge device is fed through an insulating structure and supported therein by means of field shaping electrodes. The space between the field shaping electrodes is filled with an electronegative gas. The electrodes insure that the electrical field lines merge smoothly from the low pressure region, across which high voltage is applied, into the dielectric of the coaxial cable. The structure minimizes local electrical stresses while maintaining a high voltage electrode separation in the low pressure region which is less than that at which Paschen breakdown occurs. The advantage of the present invention is its compactness of size and that it minimizes the probability of vacuum, surface, and bulk breakdown as well as Paschen breakdown.

4 Claims, 2 Drawing Figures

COMPACT HIGH VOLTAGE FEEDTHROUGH FOR GAS DISCHARGE DEVICES

The invention herein described was made in the course of or under a Contract or Subcontract thereunder with the Department of the Navy, Office of Naval Research.

BACKGROUND OF THE INVENTION

Field of the Invention

This invention relates to high voltage feedthroughs in gas discharge devices and more particularly to structures for high voltage feedthroughs in gas discharge devices which minimize the possibility of Paschen, vacuum, surface and bulk breakdown.

SUMMARY OF THE INVENTION

The high voltage feedthrough in accordance with the invention consists of a coaxial cable with a plurality of conductors which apply high voltages (up to 200 kV) to the electrodes of a low-pressure gas discharge device. Substantially tubular field shaping electrodes hold the coaxial cable in place. An interelectrode space between the field shaping electrodes is filled with an electornegative gas. A tubular ceramic insulator is located between the low pressure region and the field shaping electrodes. The field shaping electrodes and the gas therebetween insure that the electrical field lines merge smoothly from the low pressure region into the dielectric of the coaxial cable, in order to prevent electrical breakdown.

Accordingly, it is an object of this invention to provide a supporting structure for a high voltage feedthrough in a gas discharge device.

It is another object to provide optimum electrode geometry design to minimize the possibility of breakdown.

The features of the present invention which are believed to be novel are set forth with particularity in the appended claims. The present invention, both as to its organization and manner of operation, may be understood best by reference to the following description, taken in connection with the accompanying drawings.

DETAILED DESCRIPTION

Figure 1:
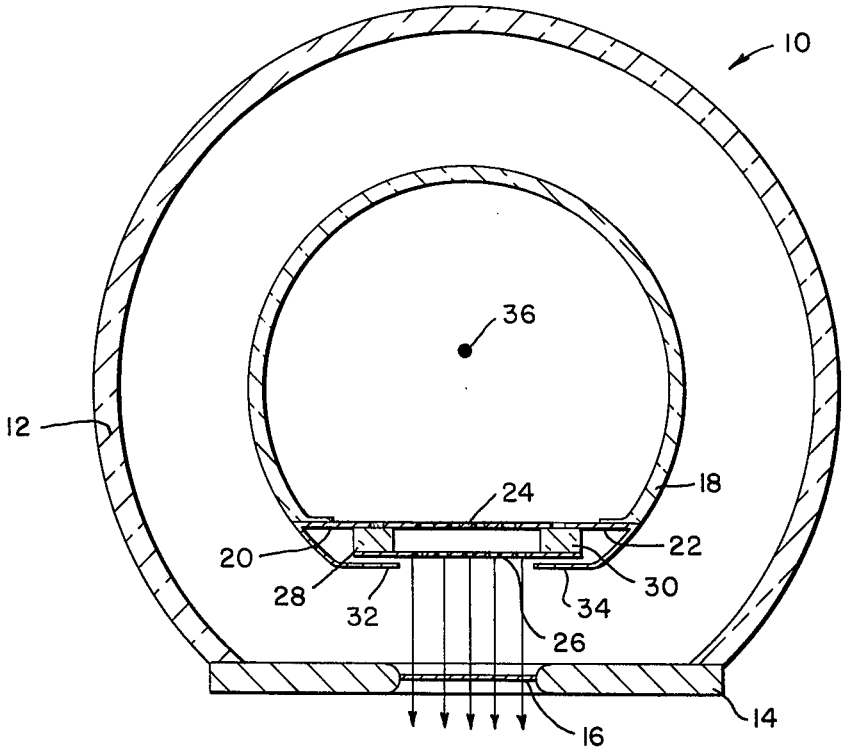
Fig. 1. PRIOR ART
FIG. 1 is a prior art hollow cathode gas discharge device.

In FIG. 1, 10 is a hollow cathode discharge device. The housing 12 serves as a shell around the discharge device. One side of the housing 12 is wall 14; the other side of wall 14 can be attached to a laser cavity or other device which needs a supply of electrons. Wall 14 has a thin foil section 16 which serves as an electron transmission window. Stainless steel or some other conductor is used for the housing 12. The foil window 16 is as thin as possible to permit electron passage with maximum freedom, but also to maintain the vacuum integrity of housing 12.

Hollow cathode 18 is mounted within housing 12 on suitable electrically insulated structural supports. Cathode 18 carries webs 20 and 22 on which are mounted insulators 28 and 30. On the inside surface of the insulator, toward the interior of cathode 18, is mounted perforated anode 24. On the other side of the insulators is mounted perforated control grid 26. The thin foil window 16 is in line with and faces the perforated electrodes. Window 16 is faced from control grid 26 and is adapted to be connected as an electron accelerating electrode. Webs 32 and 34 protect the outer surface of insulators 28 and 30 from deposition of sputtered material.

The structure of the gas discharge device 10 also includes an ignition electrode 36, which is preferably in the form of a thin wire. It extends substantially through the center of the cathode space. Power supplies provide the necessary current for operation to the respective electrodes.

In the gas discharge device of FIG. 1, a plasma is generated within the hollow cathode and is used as a source of electrons. The electrons extracted from the plasma pass through a triode type control grid structure and are accelerated to high energies in a plasma-free region prior to emerging from the device through the thin foil window 16.

For more detailed information on the prior art gas discharge device of FIG. 1, see U.S. Pat. No. 3,831,052, "Hollow Cathode Gas Discharge Device," by Ronald Knechtli, filed May 25, 1973. The patent is assigned to Hughes Aircraft Company. The subject matter of this cross-reference is incorporated herein in its entirety. A major problem with such a hollow cathode discharge device is providing a high voltage feedthrough which minimizes all important forms of electrical breakdown.

Figure 2:
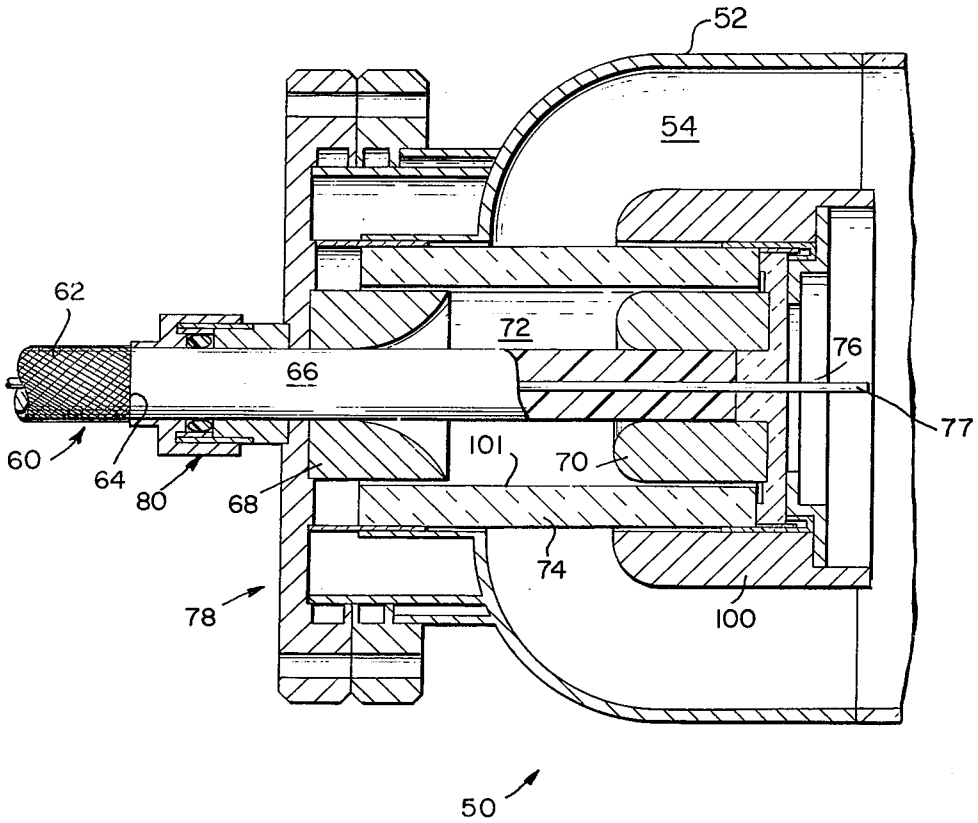
FIG. 2 is a side view of the compact high voltage feedthrough for a gas discharge device.

FIG. 2 shows the support structure 50 for a high voltage feedthrough which would be used in a gas discharge device, such as the one described in U.S. Pat. No. 3,831,052.

Housing 52 contains a low pressure gas environment in the space 54. The pressure in space 54 is maintained at a value appropriate for the maintenance of a low pressure gas discharge.

As is well known, a coaxial cable such as 60 consists of a conductor centered inside and insulated from a metal tube or shield. FIG. 2 shows the shield 62 of coaxial cable 60 to the left of point 64. To the right of point 64 the shield is removed and the insulator or dielectric 66 is exposed. In the present invention, there are a number of conductors in coaxial cable 60, which supply voltage to a number of electrodes, e.g., the ignitor, cathode, anode, and control electrodes; the positioning of these electrodes is described in U.S. Pat. No. 3,831,052, "Hollow Cathode Gas Discharge Device," by Ronald C. Knechtli.

Field shaping electrodes 68 and 70 hold cable 60 in place. Interelectrode space 72 is filled with an electronegative gas or oil. In the present case, sulfur hexafluoride ($SF_6$) is used instead of oil, since there is no possibility of trapped gas bubbles as may be possible with oil.

Tubular shaped ceramic insulator 74 is located between high voltage electrode 100 and the field shaping electrodes 68 and 70. The field shaping electrodes 68 and 70 insure that the electrical field lines merge smoothly from space 54 into the dielectric 66 of the coaxial cable 60. Mechanical attachment 76 holds field shaping electrode 70 and the ceramic insulator 74 in place. This mechanical attachment is made of stainless steel or some other metal which has good breakdown characteristics. Housing 80 holds the coaxial cable 60 in place. One or more conductors, like conductor 77, are located in coaxial cable 60. These conductors supply high voltages to such electrodes as the ignitor, cathode, and anode in a gas discharge device.

All of the electrodes are formed from stainless steel, mechanically polished and then electropolished. Other materials which would have good breakdown characteristics could be used instead of stainless steel. The gas in space 54 is helium and the gas in the interelectrode space 72 is $SF_6$. The operating pressures are between 10 – 100 milli-torr at voltages up to 200 kV.

THE OPERATION

Field shaping electrode 68 is at ground potential, whereas the inner conductor 77 of coaxial cable 60 and field shaping electrode 70 is at −200 kV. The sharp edges of the field shaping electrode 70 are curved with a radius of curvature of 0.2 cm. $SF_6$ gas fills the interelectrode space 72 in order to avoid breakdown between field shaping electrodes 68 and 70 and along insulating surface 101.

The present invention solves a major problem in building high voltage, gas discharge devices, which is the supporting and electrical biasing of one or more high voltage electrodes relative to the other within a gas filled enclosure. This is due to the simultaneous constraints imposed by surface breakdown over support insulator surfaces, bulk breakdown through insulators, vacuum breakdown, and Paschen breakdown. By varying the different parameters (e.g., electrode-insulator geometry, gas pressure, etc.), the individual regions can be widened to a greater or lesser extent. By curving the edges of the electrodes, the electrical field lines from the coaxial cable 60 can be routed, so that the limiting breakdown path will be at a voltage above operation voltage.

Although the device which has just been described appears to afford the greater advantages for implementing the invention, it will be understood that various modifications may be made thereto without going beyond the scope of the invention, it being possible to replace certain elements by other elements capable of fulfilling the same technical function therein.

What is claimed is:

1. A high voltage feedthrough for a gas discharge device, comprising:

a gas discharge device having a hole in which a coaxial cable, with at least one center conductor, is inserted;

a plurality of electric field shaping electrodes with an interelectrode space therebetween, a gas in said interelectrode space;

said device having a horizontal axis extending through it;

said shaping electrodes being substantially cylindrically shaped and positioned around said axis;

said shaping electrodes having a hole through their centers, said cable extending through said holes; said cable being secured in place by said shaping electrodes;

ends on said shaping electrodes, which are perpendicular to said axis and face each other, having curved edges to prevent breakdown between said electrodes;

a high voltage electrode;

a tubular insulator between said high voltage electrode and said shaping electrodes, said insulator having an inner and an outer surface; said inner surface facing said shaping electrodes and said outer surface facing said high voltage electrode;

said insulator having a space between its inner surface and said shaping electrodes, gas being in said space to prevent breakdown between said shaping electrodes.

2. The support structure of claim 1, wherein said shaping electrodes are metal.

3. The support structure of claim 1, wherein said gas is an electronegative gas.

4. The support structure of claim 1, wherein said insulator is ceramic.

* * * * *